United States Patent [19]

Fujiwara

[11] Patent Number: 5,044,148

[45] Date of Patent: Sep. 3, 1991

[54] YARN SPLICING METHOD

[75] Inventor: Michiaki Fujiwara, Kameoka, Japan

[73] Assignee: Murata Kikai Kabushiki Kaisha, Kyoto, Japan

[21] Appl. No.: 469,278

[22] Filed: Jan. 24, 1990

[30] Foreign Application Priority Data

Jan. 27, 1989 [JP] Japan ..... 1-18534

[51] Int. Cl.[5] ..... D01H 1/115; D01H 15/013

[52] U.S. Cl. ..... 57/22; 57/261

[58] Field of Search ..... 57/22, 261, 328, 353

[56] References Cited

U.S. PATENT DOCUMENTS

| | | | |
|---|---|---|---|
| 3,379,002 | 4/1968 | Rosenstein | 57/22 X |
| 4,693,066 | 9/1987 | Oellers | 57/22 |
| 4,790,130 | 12/1988 | Stahlecker et al. | 57/261 |
| 4,831,816 | 5/1989 | Stahlecker | 57/328 |
| 4,833,874 | 5/1989 | Stahlecker et al. | 57/22 X |

FOREIGN PATENT DOCUMENTS

| | | | |
|---|---|---|---|
| 3842120 | 6/1989 | Fed. Rep. of Germany | 57/328 |
| 35050 | 4/1978 | Japan | 57/328 |
| 139824 | 6/1989 | Japan | 57/328 |
| 221526 | 9/1989 | Japan | 57/328 |

*Primary Examiner*—Joseph J. Hail, III

*Attorney, Agent, or Firm*—Spensley Horn Jubas & Lubitz

[57] ABSTRACT

In doubling two yarns to wind it on a package, a splicing part is displaced between a splicing part of one yarn and a splicing part of the other yarn so as to present a deviation in phase when the yarns are doubled, single yarns are used to make splicing, after which the yarn is wound on the package.

6 Claims, 2 Drawing Sheets

YARN SPLICING METHOD

FIELD OF THE INVENTION

The present invention relates to a yarn splicing method for splicing one or both yarns which are cut in case where the two yarns are doubled and wound.

RELATED ART STATEMENT

A doubler has been used in which after spinning step, two yarns obtained by drafting a sliver and twisting it by an air twisting nozzle are doubled and taken-up in their arranged state. In this doubler, when one or both yarns are cut, a yarn joining operation must be done. Yarn joining members known include a knotter or a splicer. In case of using a knotter, a knot is formed, and therefore, in the case of joining spun yarns, a splicer is preferably used.

In the splicer, fibers of both yarn ends to be spliced are unfastened, both the yarn ends are superimposed against which compressed whirling air is blown to wind the fibers in the twisted state whereby both the yarn ends are formed into one joint. Therefore, a knot formed as a result of piecing by the knotter is not formed but when detailed observation is made, an occurrence of a change in fiber density and a slight bulge may be seen.

Even in case of the splicing by use of the splicer, four yarns in total, i.e., two yarn ends on the spinning side and two yarn ends on the winding side of doubling and taking-up can be simultaneously spliced.

When two yarns are cut, the yarn end on the spinning side and the yarn end on the taking-up side are joined by the splicer, then two yarns are present before and behind the spliced part but only one yarn is present in the spliced part. In case where said yarn is twisted in the posterior step, the joint is different from the spliced part in twisting state, which is not a preferable a yarn depending on the use or product. It is therefore contemplated that in doubling two yarns, splicing members are set in the yarn running areas of two yarns to separately splice two yarns. In this case, however, when the phases of the splicing parts are the same in two yarns, an unsplicing part is slightly different in construction from a splicing part even in the case of joining by the splicer. Therefore, when the splicing parts of two yarns are positioned at the same phase and in the case where the yarn is twisted in the posterior step, an amplified difference relative to other parts occurs in terms of properties of yarns.

OBJECT AND SUMMARY OF THE INVENTION

In view of the foregoing, it is an object of the present invention to provide a yarn splicing method in which when a yarn cut occurs in taking-up two yarns, splicing is effected in a manner such that a particularly large change does not occur in a piecing part as compared with other parts.

In the case where there is a need for yarn splicing in doubling two yarns to wind it on a package, a splicing part is displaced between a splicing part of one yarn and a splicing part of the other yarn so as to present a deviation in phase when the yarns are doubled, single yarns are used to make the splice, after which the yarn is wound on the package.

DETAILED DESCRIPTION OF PREFERRED EMBODIMENT

Figure 1:
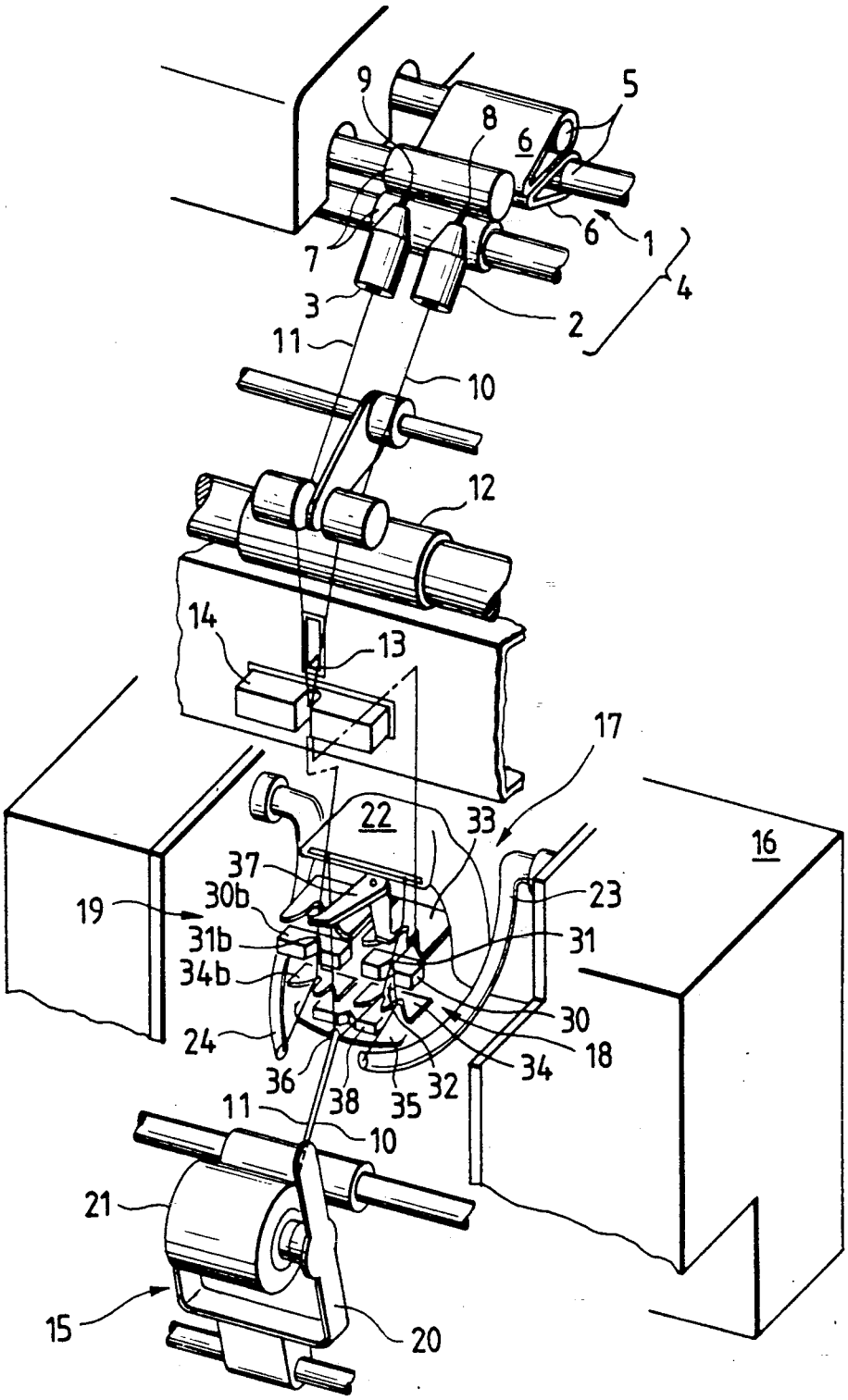
FIG. 1 is a schematic perspective view showing an apparatus for carrying out the method of the present invention.

An embodiment of the present method will be described hereinafter together with one example of an apparatus for carrying out the method of the present invention.

In the illustrated example, a yarn splicing is carried out by a splicer in a spinning machine for winding two yarns. Air jetting nozzles 2 and 3 are provided after a draft device 1 to constitute a spinning apparatus 4. A back roller is not shown in the draft device 1. Aprons 6 and 6 are placed over a top and bottom middle rollers 5 and 5, respectively, and drafting of a sliver (not shown) is carried out between front rollers 7 and 7. The rollers 5, 7 and apron 6 are wider than a normal roller which drafts a single sliver, and two slivers can be similarly nipped and drafted. Staple fiber bundles 8 and 9 delivered from the front rollers 7 and 7 are twisted by air jetting nozzles 2 and 3. The air jetting nozzle 2 blows a whirling air stream in a tangential direction against the staple fiber bundle 8 introduced from the extreme end thereof to thereby twist the staple fiber bundle 8, and the fluff-like fiber end (not shown) in the outer periphery of the staple fiber bundle 8 is wound about a core fiber (not shown) to thereby spin the staple fiber bundle 8 on a yarn 10. The air jetting nozzle 3 also forms a staple fiber bundle 9 into a yarn 11 similarly to the air jetting nozzle 2. Reference numeral 12 designates a delivery roller, 13 a slack tube and 14 a slub catcher under which is provided a winder 15 to constitute a spinning and winding unit, which is mounted on a frame not shown.

A work carriage 16 which moved along the row of spinning and winding units in which a plurality of said spinning and winding units are lined is placed on a guide rail. A yarn splicing device 17 in addition to a doffer not shown are mounted on the work carriage 16. The yarn splicing device 17 comprises a splicer 18 as a splicing member for splicing a first yarn 10 and a splicer 19 as a splicing member for splicing a second yarn 11, and further comprises a suction mouth 22 for sucking a yarn end on the side of a package 21 supported on a cradle 20 of a winding device 15 to guide said yarn end to the splicer, a suction nozzle 23 for sucking a yarn 10 on the spinning side to guide said yarn end to the splicer 18, and a suction nozzle 24 for sucking the yarn 11 on the spinning side to guide said yarn end to the splicer 19.

The splicers 18 and 19 are of the same type, and therefore, the outline of the splicer 18 will be described and in the description of the splicer 19, reference character "b" of is applied to the reference numerals of the splicer 18 for parts corresponding to those of the splicer 18.

Figure 2:
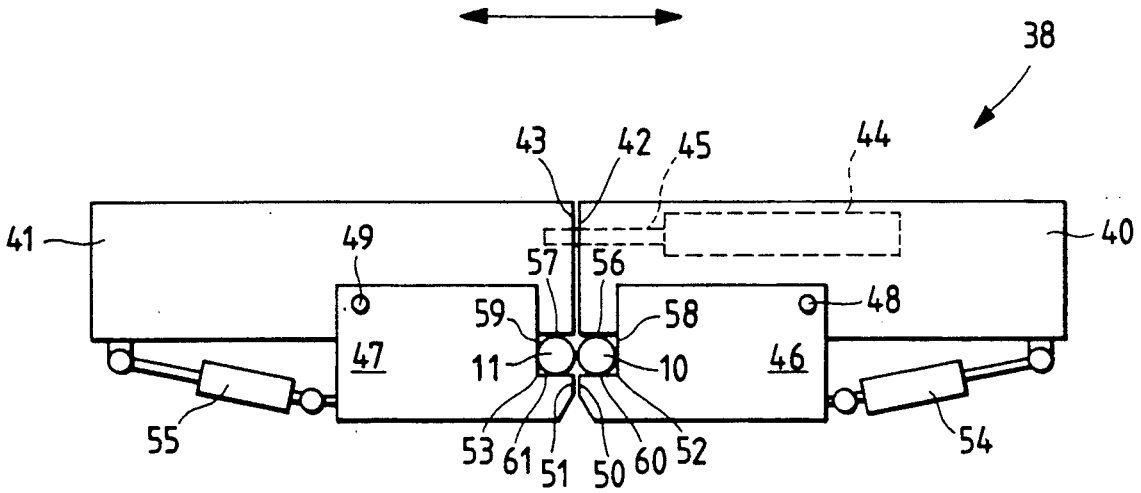
FIG. 2 is a plan view of a yarn separator.

Reference numeral 30 designates a splicing member having at the front surface a yarn introducing groove 32 opened toward a central yarn passage 31, in which compressed air is injected toward the central yarn passage 31 and toward the yarn from the periphery thereof in a tangential direction to twist the yarn. The splicing member 30 is vertically provided with yarn guide members 33, 34, 35 and not-shown yarn-end untwisting member. The guide member 35 is in the form of a plate so that a position of a yarn guide groove 36 provided in the end edge of the plate-like body is deviated to either left or right from a center line to change a length of a yarn running area between the yarn guide groove 36 and the yarn passages 31 and 31*b* of the left and right splicing members 30 and 30*b*. Reference numeral 37 designates a yarn drawing lever and 38 a yarn separator. The yarn separator 38 is the device for separating a yarn returned in its doubled state from the package 21 into a single yarn in order that said yarn is fed in the form of a single yarn into the splicers 18 and 19. As roughly shown in FIG. 2, yarns 10 and 11 drawn out of the package 21 are indicated thick for easy illustration. Reference numerals 40 and 41 designate base blocks having opposed surfaces 42 and 43. One or both of the base blocks 40 and 41 are movably supported so that they may be placed in contact and moved away in the abutment surfaces 42 and 43. A fluid cylinder 44 for moving the base block is provided within the base block 40. A piston block 45 of the fluid cylinder 41 has its extreme end secured to the base block 41 so that when the piston rod is projected, the base block 40 and the base block 41 open the abutment surfaces 42 and 43. In the base blocks 40 and 41, yarn keep blocks 46 and 47 are supported swingably by shafts 48 and 49, respectively. The sides of the yarn keep blocks have an inverted-] shape in section, which are loosely fitted into the base blocks 40, 41, respectively. The yarn keep blocks 46 and 47 have confronted end surfaces 50 and 51, close to which are positioned the base blocks 40 and 41 so that they are in the same phase as the abutment surfaces 42 and 43 when the latter are in close contact. The confronted end surfaces 50 and 51 of the yarn keep blocks 46 and 47 are formed at their lower portions with shoulders 52 and 53 having approximately same size as a diameter of a single yarn which can hold only one yarn 10 or 11 therebetween. In the yarn keep blocks 46 and 47, fluid cylinders 54 and 55 are provided between the base blocks 40 and 41.

The abutment surfaces 42 and 43 of the base blocks 40 and 41, and the confronted abutment surfaces 50 and 51 of the yarn keep blocks 46 and 47 are positioned on the same phase, and the shoulders 52 and 53 hold the single yarns 10 and 11 between the upper surfaces of the base blocks 40 and 41 in the state where the base blocks 40 and 41 and the yarn keep blocks 46 and 47 are in abutment with each other.

The yarns 10 and 11 spun by the spinning device 4 in a conventional manner are delivered by the delivery roller 12 and wound on the package 21 of the winder 15 in their arranged state via the slab catcher 14. Suppose that both yarns 10 and 11 are cut, at this time, the yarn end on the winding side is wound on the package 21. The yarn end on the package side wound on the package 21 is first sucked and drawn by the suction mouth 22 which has moved toward the package 21 and rotated while reversely rotating the package 21, and the suction mouth 22 assumes the position shown in FIG. 1. The yarns 10 and 11 drawn out of the package 21 enter the guide groove 36 of the yarn guide member 35. Then, the doubled yarns are separated into the single yarns 10 and 11 one by one by the yarn separator 38 provided between the yarn guide member 35 and the yarn guide member 34 positioned at a higher level than the former. The function thereof will be described hereinafter.

When the yarn is drawn from the package 21 by the whirling rotation of the suction mouth 22, the whole yarn separator 38 moves forward in the direction of the yarn running area. The cylinders 54 and 55 are operated to turn the yarn keep blocks 46 and 47 about the shafts 48 and 49 to open them in the form of a ∩-shape, the doubled yarn comprised of the single yarns 10 and 11 is introduced between the yarn keep blocks 46 and 47 to place them in their interposed state on nipped surfaces 56 and 57 of the base blocks 40 and 41 of the yarn separator 38. At this time, the yarn 10 is guided in its bended state at the position of the yarn guide 34 in view of the positions of the yarn guides 34 and 34*b* and therefore comes into contact with a positioning surface 58 constituting a shoulder 52 of the yarn keep block 46 whereas the yarn 11 comes into contact with a positioning surface 59 constituting a shoulder of the yarn keep block 47.

Then, when the cylinders 54 and 55 are released from their operation to restore the yarn keep blocks 46 and 47 to their initial positions (indicated in FIG. 2), the single yarn 10 is nipped by a nip surface 60 of the yarn keep block and a nip surface 56 of the base block 40 in the state where the yarn is in contact with the positioning surface 58 of the yarn keep block 46, whereas the yarn 11 is nipped by a nip surface 61 of the yarn block and a nip surface 57 of the base block 41 in the state where the yarn is in contact with the positioning surface 59 of the yarn keep block.

Next, when the fluid cylinder 44 provided on the base block 40 is operated so that the abutment surfaces of the base blocks 40 and 41 are pushed open by the piston rod 45, the single yarns 10 and 11 are separated to left and right while being sandwiched between the nip surfaces 56, 60 and the nip surfaces 57, 61. The single yarns 10 and 11 thus separated by the aforesaid movement are engaged by the guide members 34 and 34*b* in their separated state. Under this state, the cylinders 54 and 55 are operated whereby the yarn keep blocks 46 and 47 are turned to release the holding of the single yarns 10 and 11 which were opened in the form of a ／＼-shape and held, thus completing separation of the yarns.

In this way, the separated single yarns 10 and 11 enter the splicers 18 and 19, respectively. The yarn guide groove 36 of the yarn guide member 35 is different in length from the splicing members 30 and 30*b* of the splicers 18 and 19, and as a result, the parts where both of the single yarns 10 and 11 are spliced are deviated in phase to prevent the arranged yarns from being spliced at the same phase part.

While in the above-described embodiment, the distance from the package 21 to the splicers for the respective single yarns are made the same and the course of one single yarn is bended to change the length of the yarn running area of both the single yarns, it is to be noted that the yarn running areas for both the single yarns may be made approximately the same to change the positions of the splicers thus changing the phase of the splicing part.

The fibers constituting the yarn ends of the yarns 10 and 11 drawn out of the package 21 introduced into the splicer 18 by the suction mouth 22 and the yarns 10 and 11 on the spinning side drawn by the suction nozzles 23 and 24 are unfastened by the flow of pressure air in the untwisting member not shown at the part where they have passed through the splicing members 30 and 30*b*. Both the thus untwisted yarn ends on the spinning side and the yarn end on the package side are returned into the splicing members 30 and 30*b*, and pressure air is applied in a tangential direction thereto in the form wherein they are abutted each other, and they are twisted by the turning flow. Both the yarn ends are formed into a single yarn by this twisting.

Figure 3:
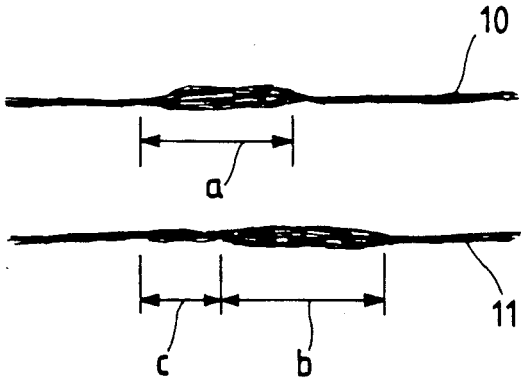
FIG. 3 illustrates a yarn splicing portion.

It is noted that a deviation in phase in the above-described embodiment does not only refer to that the splicing parts are completely superimposed but a deviation about half of the length of the splicing portion as shown in FIG. 3 which poses little problem in practical use is also included. That is, in FIG. 3, this may be $a=a/2$ or $c=b/2$, preferably, $c>a/2$ or $c>b/2$.

According to the method of the present invention, in case where need of yarn splicing occurs in doubling two yarns to wind it on a package, a splicing part is displaced between a splicing part of one yarn and a splicing part of the other yarn so as to present a deviation in phase when the yarns are doubled, single yarns are used to make splicing, after which the yarn is wound on the package. Therefore, in the arranged yarn, parts to be spliced are different in phase, and unevenness of yarn in the package on which two yarns are wound can be minimized.

What is claimed is:

1. A yarn splicing method for splicing two yarn strands being doubled and wound on a package from a spinning machine, said method comprising the steps of:

displacing a first splicing portion of one yarn strand of the two yarn strands associated with the package side and a second splicing portion of the one yarn strand associated with the spinning device side from third and fourth splicing portions of the other yarn strand of the two yarn strands associated with the package side and the spinning device side, respectively, splicing the one yarn strand together with the first and second splicing portions, splicing the other yarn strand together with the third and fourth splicing portions, doubling the one yarn strand and the other yarn strand, and winding the doubled yarn strands onto the package, wherein the displacing of the first and second splicing portions from the third and forth splicing portions enables a deviation in phase between the splice in the one yarn strand and the splice in the other yarn strand when the spliced yarns are doubled.

2. The yarn splicing method as claimed in claim 1, wherein the splicing steps include the steps of:

unfastening fibers of the respective splicing portions of the yarn strands to be spliced, superimposing the respective splicing portions against one another, blowing compressed whirling air against the superimposed splicing portions to wind the fibers in a twisted state to form a joint.

3. The yarn splicing method as claimed in claim 2, wherein said displacing step further comprises the steps of:

maintaining the travelling path from the package to one of the first and third splicing portions of the two yarn strands constant, bending the travelling path from the package to the other of the first and third splicing portions of the two yarn strands to change the length of the yarn running area of the two yarns.

4. A yarn splicing apparatus for use in a device where two yarns are doubled and wound on a package, the apparatus comprising:

means for unfastening fibers of both yarns ends to be spliced, means for superimposing both of the yarn ends, means for blowing compressed whirling air against the superimposed yarn ends to wind the fibers in a twisted state to form the yarn ends into one joint, and a yarn guide member positioned between a pair of splicing members and the package, the yarn guide member including a yarn guide groove which is deviated from a center line of the yarn splicing apparatus to change a length of a yarn running area between the yarn guide groove and respective yarn passages of the splicing members, thereby providing a deviation in phase between the splices in the two yarn strands when the spliced yarns are doubled.

5. The yarn splicing apparatus as claimed in claim 4, further comprising a yarn separator for separating strands of a doubled yarn, returned in its doubled state from the package, into single yarn strands, the yarn separator being provided between at least one of the yarn splicing members and the yarn guide member so that yarns are fed as single yarn strands into the splicing members, respectively.

6. The yarn splicing device as claimed in claim 5, wherein said yarn separator comprises a pair of base blocks being movably supported to be placed in contact and moved away in abutment surfaces, a first fluid cylinder for moving at least one of the base blocks, yarn keep blocks swingably supported on the base blocks, respectively, said yarn keep blocks providing shoulders having a diameter substantially equal to a single yarn, and a second fluid cylinder provided between at least one base block and at least one yarn keep block.

* * * * *